United States Patent [19]

Lee

[11] 4,112,552

[45] Sep. 12, 1978

[54] THREE-WAY SLIDE FASTENER

[76] Inventor: Haeng Yong Lee, 1091, Seocho-dong, Kangnam-ku, Seoul, Korea

[21] Appl. No.: 717,180

[22] Filed: Aug. 24, 1976

[30] Foreign Application Priority Data

Aug. 27, 1975 [KR] Rep. of Korea ..... 1896

[51] Int. Cl.[2] ..... A44B 19/02; A44B 19/04

[52] U.S. Cl. ..... 24/205 R; 24/205.13 R; 24/205.15 R

[58] Field of Search ..... 24/205 R, 205.13 R, 24/205.12

[56] References Cited

U.S. PATENT DOCUMENTS

| | | | |
|---|---|---|---|
| 2,178,885 | 11/1939 | Buff | 24/205 R |
| 2,275,454 | 3/1942 | Miller | 24/205.12 |
| 2,483,057 | 9/1949 | Levering | 24/205 R |
| 2,727,290 | 12/1955 | Planas | 24/205.13 R |

FOREIGN PATENT DOCUMENTS

| | | | |
|---|---|---|---|
| 334,287 | 1/1959 | Switzerland | 24/205 R |

*Primary Examiner*—Bernard A. Gelak
*Attorney, Agent, or Firm*—Holman & Stern

[57] ABSTRACT

Disclosed is an embodiment of a conventional zipper in which a single slide fastener joins teeth mounted on three surfaces allowing closure of two separate compartments with one movement. Further disclosed is a slide fastener in which two surfaces are independently connected to a third common surface through separate slide fasteners but utilizing one common surface. Additionally disclosed are details of the fastening teeth which allow the sliders to be supported thereon.

4 Claims, 17 Drawing Figures

THREE-WAY SLIDE FASTENER

BACKGROUND OF THE INVENTION

This invention relates to a slide fastener.

It is well known to use a slide fastener to lock a single aperture of a container or package as in bags, handbags, tool cases or instrument bags, and/or vinyl cabinets, etc. Thus, where the bag has two separate compartments, two separate slide fasteners are utilized because the prior art fasteners are comprised of a pair of flank tapes having a single head toothed element and is applicable to a single aperture only. Accordingly, because each aperture must be equipped separately with fasteners, the prior art has the disadvantages not only that the work to incorporate the fastener in the products is troublesome and raises the production costs, but also that the users suffer inconvenience during the use.

SUMMARY OF THE INVENTION

An object of this invention is to provide a three-way fastener that can be utilized in a bag with two separate compartments to open or close the bag simultaneously with a single slider.

Another object of this invention is to offer a three-way slide fastener that can be utilized in a bag having two separate compartments to close or open them separately by means of two separate sliders.

More particularly, this invention is concerned with a three-way slide fastener consisting of a pair of the flank tapes having the single head teeth elements and an intermediate fastening tape having dual head teeth elements that are locked in the form of the T-shape with both of the flank tapes having the single head teeth elements or are unlocked therefrom by one or two sliders.

BRIEF DESCRIPTION OF THE DRAWINGS

Further explanation of this invention is illustrated in detail in accordance with the accompanying drawings as follows.

DETAILED DESCRIPTION OF A PREFERRED EMBODIMENT

Figure 1:
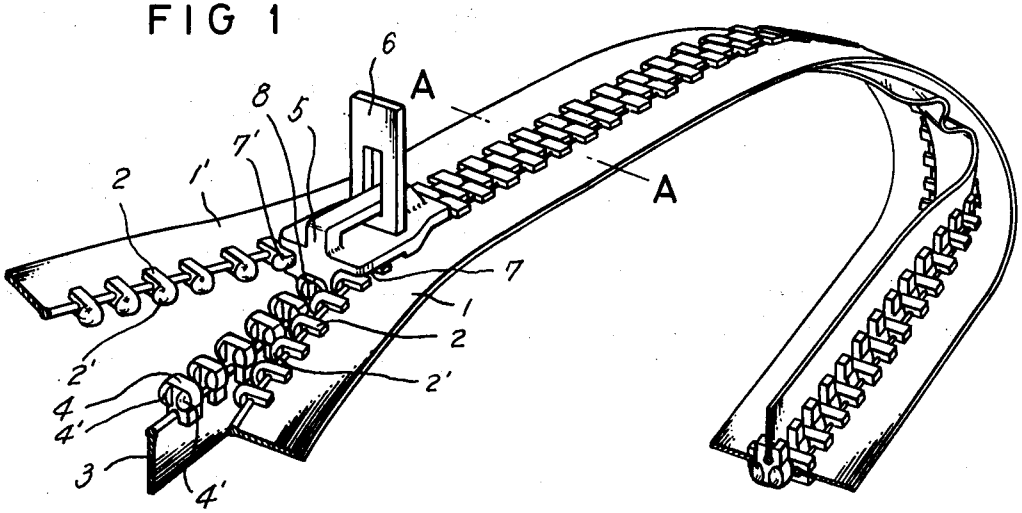
FIG. 1 is a perspective view of an example of this invention.
Figure 2:
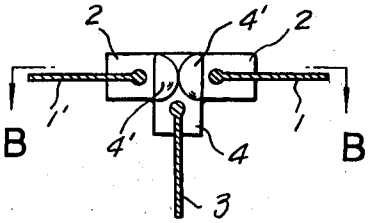
FIG. 2 is a cross-sectional view of the embodiment of FIG. 1 along the line A—A.

An example of the present invention is illustrated in the FIGS. 1 to 5, from which the three-way fastener characterized by this invention can be observed in detail.

According with the invention, the fastener consists of three rows of tooth tapes, 1, 1' and 3 that are mutually interlocking in the form of a T-shape through the slider 5. Each of the flank tapes 1 and 1' consists of the teeth elements 2 having the single head 2' and the intermediate tape 3 of the tooth element 4 having a dual head 4'. The dual head 4' of the tooth element 4 in the intermediate tape 3 is interlocked in the form of the T-shape with the single heads 2' of the teeth elements 2 in the flank tapes 1 and 1' by the slider 5 so that the three directions, linked in the form of the T-shape with each of the teeth tapes 1, 1' and 3, can simultaneously interlock two apertures of a bag consisting of two separate compartments by a single slider 5.

Figure 4A:
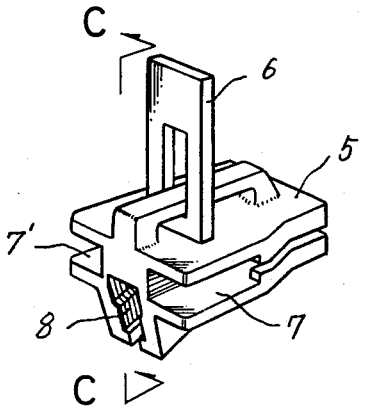
FIGS. 4*a* and 4*b* are perspective views of the fastening slider shown in FIG. 1, observed from the above and below, respectively.
Figure 4B:
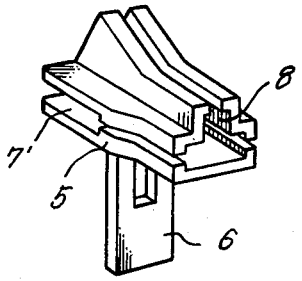
Figure 5:
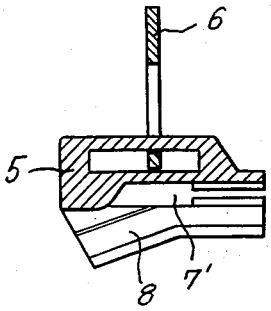
FIG. 5 is a longitudinal cross-sectional view of the fastening slider of FIG. 4*a* along the line C—C.

As shown in FIGS. 4 and 5, the slider 5 having a handle 6, consists of the passage 7 and 7' along both sides of the slider for flank tapes 1 and 1' and, additionally, a passage 8 on the bottom of the slider for the intermediate tape 3.

Figure 3:
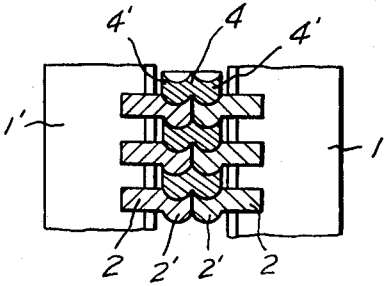
FIG. 3 is a cross-sectional view of the embodiment in FIG. 1 along the line B—B of FIG. 2.

When the slider 5 is moved to close the fastener, the three tapes 1, 1' and 3 are mutually interlocked as shown in FIG. 3. Each of the flank tapes 1 and 1' are introduced through each of the passages 7 and 7' of the slider 5 and the intermediate tape 3 is introduced through the passage 8. They are interlocked in the form of a T-shape by the sliding operation of the slider 5.

When the slider 5 is operated to unlock the fastener, the interlocked fastener is divided individually into three element tapes 1, 1' and 3 by each of the passages 7, 7' and 8 of the slider 5 so that the fastener is separated.

Figure 6A:
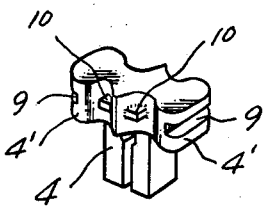
FIG. 6*a* is a perspective view of the dual head tooth element of an intermediate tape.
Figure 6B:
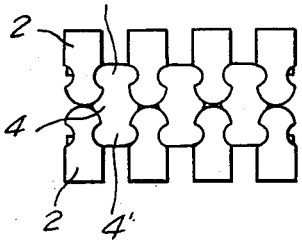
FIG. 6*b* is the plan view showing the dual head tooth element interlocked with the single head teeth elements.

Another example of the dual head tooth element is illustrated on the FIG. 6*a*. The dual head tooth element 4' is same as the one in FIGS. 1–5 except for grooves 9 along both sides of the dual head tooth element 4' and the fixing points 10 on the inner side of each of both concaves forming the dual head 4, so that the teeth elements 4' can be interlocked tightly with each single head teeth element 2'.

Figure 7:
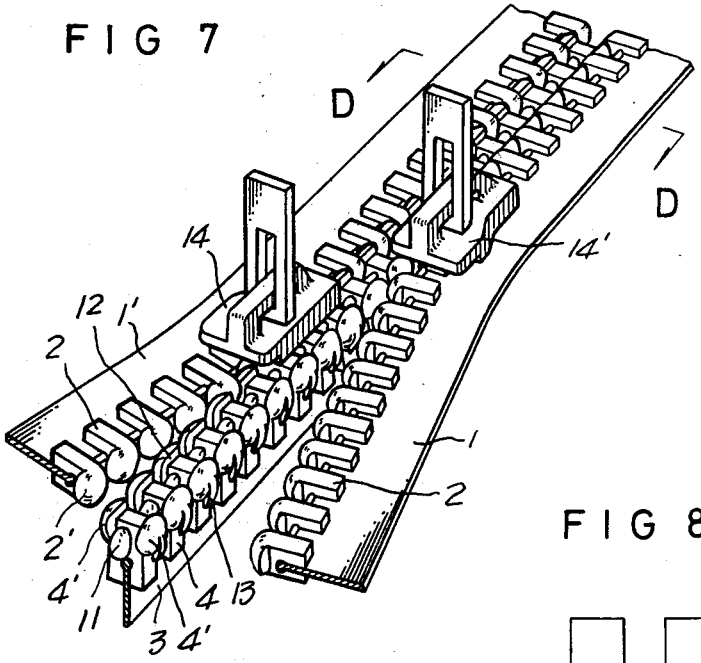
FIG. 7 is a perspective view of another embodiment of the instant invention.
Figure 8:
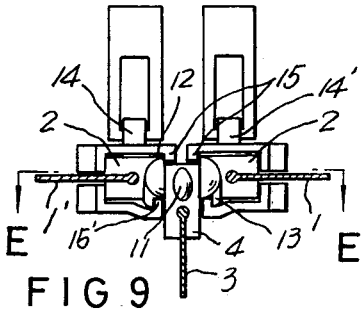
FIG. 8 is a cross-sectional view of the embodiment of FIG. 7 along the line D—D of FIG. 7.
Figure 9:
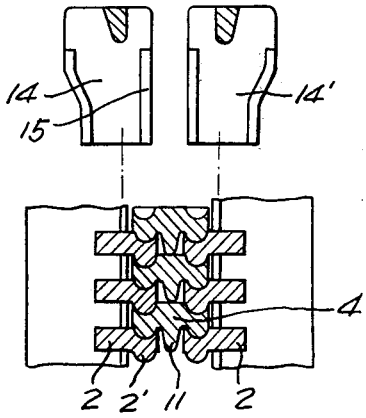
FIG. 9 is a transverse cross-sectional view of the embodiment of FIG. 8 along the line E—E.
Figure 11A:
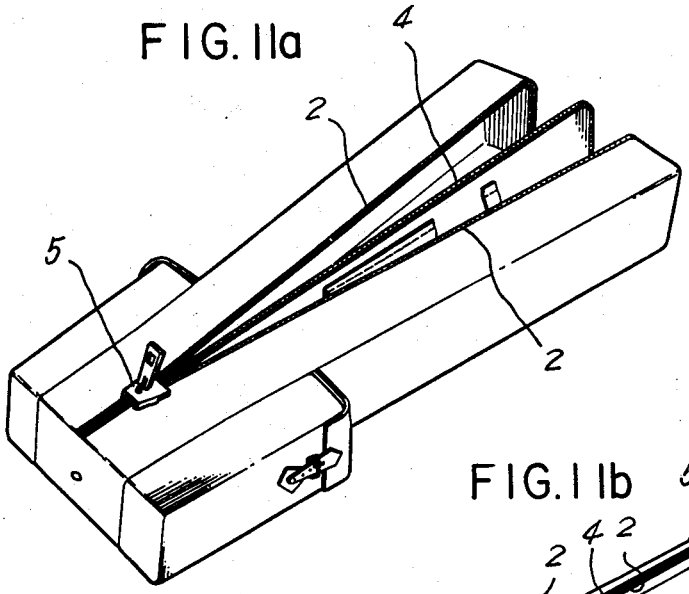
FIG. 11*a, b, c* and *d* are the examples showing applications of the present invention.
Figure 11B:
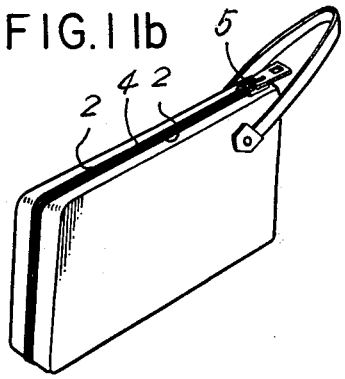
Figure 11C:
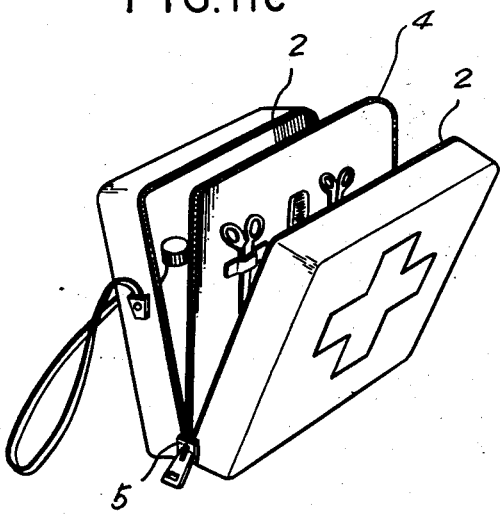
Figure 11D:
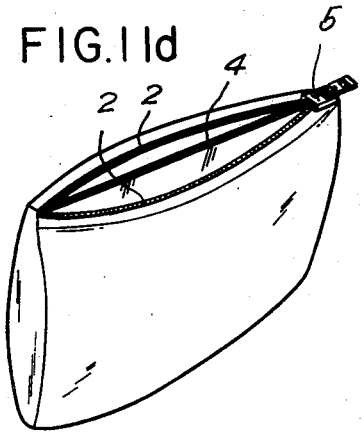

Another example of the present invention is illustrated in detail on the FIGS. 7, 8 and 9. The construction of the fastener is similar to the earlier mentioned embodiments in that each of the flank tapes 1 and 1', consisting of the single head tooth elements 2, is interlocked in the form of the right angle with one side of the intermediate tape 3 consisting of the dual head tooth element 4. In order to support the movement of the sliders 14 and 14°, the fastener shown in this embodiment has the space between teeth elements 4 widened by the space-maintaining fixture 11. The upper part of the tooth element 4 is lowered to form the supporting line 12 for the sliders 14 and 14'. The bottom of the tooth element 4 having the dual head teeth 4' is mounted with the supporting point 13, so that each of the sliders 14 or 14' can slide along the track formed between the single head tooth element 2 and the dual head tooth 4'. The sliders 14 and 14' have some construction and, as shown on the FIG. 8, have the supporting edges 15 and 15' touching on the supporting line 12 and the supporting point 13 located on the upper part and the lower part, respectively, of each of the dual head teeth 4'.

Therefore, it is possible to interlock separately either of flank tapes 1 or 1' with one side of the intermediate tape 3 having the dual head tooth element by sliders 14' or 14.

Figure 10A:
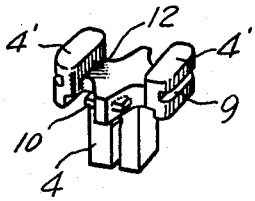
FIG. 10*a* is a perspective view of a further embodiment of the dual head tooth element.
Figure 10B:
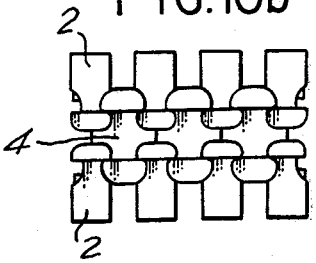
FIG. 10*b* is a plan view showing that the dual head tooth element of FIG. 10*a* interlocked with both single head teeth elements.

FIG. 10*a* shows a further example of a dual head tooth element which is compatible with the system of two separate sliders. This element is modified similar to the one shown on the FIG. 6*a*.

FIG. 11 shows embodiments of the present invention applied to bags consisting of two compartments. Example (a) is the fishing tackle bag; example (b) a hand bag; example (c) a portable medicine box; and example (d) a coin purse.

As explained above, because the fastener of this invention can be used on bags and/or containers consisting of two separate compartments, it is possible to lock or unlock simultaneously by a single slider; or to lock or unlock separately by each of two separate sliders. This is not only convenient and simple in use, but also economical in the manufacture of the products utilizing such fasteners as compared with the prior art zippers.

What is claimed is:

1. A three-way slide fastener comprising:

first flank means for providing a first row of single head teeth elements;

second flank means for providing a second row of single head teeth elements;

intermediate tape means for providing a row of teeth elements each element being a dual head; and slider means for selectively interlocking and releasing said first and second flank means to and from said intermediate tape means wherein said slider means is comprised of two independently operable sliders, each slider capable of selectively interlocking and releasing only one of said flank means to and from said tape means.

2. The apparatus of claim 1 wherein said first flank means includes a surface, said second flank means includes a second surface, and said intermediate tape means includes a third surface, wherein said slider means in interlocking said first and second surfaces to said third surface, orients said first and second surfaces at right angles to said third surface of said tape means.

3. The apparatus of claim 1 wherein said tape means comprises a surface having an edge with dual head teeth elements mounted in a row therealong.

4. The apparatus of claim 1 wherein said tape means further includes space-maintaining means for spacing said dual head teeth elements apart; said dual head teeth elements including groove means for supporting said slider and for allowing each of said sliders to operate independently of the other.

* * * * *